US005775010A

United States Patent [19]

Kaneko

[11] Patent Number: 5,775,010

[45] Date of Patent: Jul. 7, 1998

[54] SOLES FOR SPIKED TRACK-AND-FIELD SHOES

[75] Inventor: Yasunori Kaneko, Osaka, Japan

[73] Assignee: Mizuno Corporation, Osaka, Japan

[21] Appl. No.: 662,109

[22] Filed: Jun. 14, 1996

[30] Foreign Application Priority Data

Jun. 14, 1995 [JP] Japan ..... 7-172932

[51] Int. Cl.[6] ..... A43B 5/00; A43C 15/00

[52] U.S. Cl. ..... 36/129; 36/134; 36/67 R; 36/67 A

[58] Field of Search ..... 36/67 R, 67 A, 36/77 R, 114, 126, 127, 128, 129, 134

[56] References Cited

U.S. PATENT DOCUMENTS

| | | | |
|---|---|---|---|
| 4,098,011 | 7/1978 | Bowerman et al. | 36/129 |
| 4,194,310 | 3/1980 | Bowerman | 36/128 |
| 4,439,936 | 4/1984 | Clarke et al. | 36/129 |
| 4,748,753 | 6/1988 | Ju | 36/134 |
| 4,785,558 | 11/1988 | Shiomura | 36/114 |
| 4,833,796 | 5/1989 | Flemming | 36/67 D |
| 5,513,451 | 5/1996 | Kataoka et al. | 36/129 |

FOREIGN PATENT DOCUMENTS

| | | | |
|---|---|---|---|
| 1485576 | 3/1973 | Germany | 36/129 |
| 2-98703 | 8/1990 | Japan . | |
| 5-63308 | 8/1993 | Japan . | |
| 5-72801 | 10/1993 | Japan . | |
| 6-24505 | 4/1994 | Japan . | |

*Primary Examiner*—M. D. Patterson
*Attorney, Agent, or Firm*—Evenson, McKeown, Edwards & Lenahan, PLLC

[57] ABSTRACT

A sole for spiked track-and-field shoes has a wrap-up portion which extends via a coupling portion from a leading tip of a toe region of the sole proper. Multiple skid-preventing protrusions are fixed onto the toe region of the sole proper, the coupling portion, and the wrap-up portion in a perpendicular manner to the toe region of an underneath part of the sole, a surface of the coupling portion, and a surface of the wrap-up portion, respectively. The skid-preventing protrusions are formed higher than a line which connects the first row of the tips of the spike pins and the tips of the toe portion but lower than the spike pins.

4 Claims, 4 Drawing Sheets

SOLES FOR SPIKED TRACK-AND-FIELD SHOES

BACKGROUND OF THE INVENTION

1. Field of the Invention

The present invention relates to the construction of a spiked track-and-field shoe, particularly to the sole of a spiked track-and-field shoe which is excellent in the ability to grip the running surface directly before taking off from the ground during running movements in sprint events.

2. Description of Related Art

Conventionally, various materials have been employed for the soles of spiked shoes used for track-and-field sport events. Particularly, sprint events are the events in which 1/100 of a second makes a difference; thus, spiked track-and-field shoes used for these events have been researched with the main concern being that the spike pins should grip the running surface with certainty, and that the leg strength of the athlete should be transferred to the running surface without any loss of power.

Further, in recent years, the ability for the sole to grip the running surface directly before it takes off from the ground during running motion has received much attention, and the development and practical use of spikes or protrusions on the toe region of spiked track-and-field shoes has become more prevalent.

The number of spike pins which have the greatest effect on the ability to grip the running surface are somewhat limited due to consideration of the weight of the entire shoe and the flexibility of the sole.

Therefore, in order to assist in the gripping ability of the running surface, a number of protrusions have come to be arranged on the surface of the sole.

Particularly, spiked track-and-field shoes which have rows of small protrusions like teeth in an approximately perpendicular manner along the outside of the toe region of the sole surface are most commonly used.

Further, disclosed in Japanese Utility Model Laid-Open No. 5-63308 are spiked track-and-field shoes which possess spikes protruding with an incidence angle slightly toward the forward direction as compared to being perpendicular to the toe region, for the purpose of heightening the ability to grip the running surface.

The aforementioned conventionally used spiked track-and-field shoes posed the following problems.

That is, concerning spiked track-and-field shoes which do not have the protrusions surrounding the toe region, in the condition where the spike pins are penetrating the running surface, retaining force is applied, and the kick power continues on to become the power that moves the athlete forward; however, during one set of running motions, when the spike pine in the front row of the forward portion of the foot pull out, the shoe continues to be in contact with the ground along the curved surface of the portion. Because there are no protrusions to grip the running surface, the ability to grip the running surface is dramatically reduced, and kick power is lost.

Further, concerning spiked track-and-field shoes used most commonly which have rows of small protrusions like teeth approximately perpendicular towards the bottom along the outside of the toe region of the sole surface; even after the front row spike pins pull out, the aforementioned small protrusions grip the running surface and therefore the loss of kick power can be prevented to a certain degree; however, there has been the problem of not being able to hold the grip until the instant that the toe takes off from the ground, due to the aforementioned small protrusions only being located perpendicular towards the bottom.

In addition, because the aforementioned small protrusions are only lined up in a row along the periphery of the toe region, depending on the angle of the kick, or due to personal differences, there have been instances where not all of the aforementioned small protrusions could grip the running surface effectively, and the loss of kick power could not be avoided.

Further, the spiked shoes for track-and-field use disclosed in the Japanese Utility Model Laid-Open No. 5-63308 have a spiked portion which protrudes slightly forward as compared to being perpendicular to the toe region, and as a result, it became possible to grip the running surface until the instant that the toe portion took off from the ground.

However, because the aforementioned spiked portion is formed to a length of 5 mm to 9 mm forward from the toe portion, a so-called digging-up action occurs from the time the aforementioned spike pierces the running surface.

Here, a digging-up action is referred to an the action of the back side of the spike pin digging up the running surface as the spike pin which pierced the running surface rotates with its base portion acting as its center. When this happens, if the running surface is en-tout-cas, not much effort is used in the digging-up action; however, today running surfaces are generally made from synthetic resin or from rubber, which possess elasticity, and in theses instances much effort is required in the digging-up action, and the spikes do release as easily at the instant of take-off. Accordingly, while the ability to grip the running surface was kept, the problem occurred that it in turn caused resistance.

SUMMARY OF THE INVENTION

The soles of spiked track-and-field shoes according to the present invention comprises multiple spike pine and multiple skid-preventing protrusions; wherein a wrap-up portion is formed via a coupling portion from the leading tip of the sole onto the too region of the upper; the multiple skid-preventing protrusions which are fixed onto the toe region of the sole proper, the coupling portion, and the wrap-up portion are fixed perpendicular to the surface of the sole, the surface of the coupling portion, and the surface of the wrap-up portion, respectively, and the height of the aforementioned skid-preventing protrusions are formed to be higher than a line which connects the first row of the tips of the spike pins and the tips of the toe portion of the sole, but lower than the spike pins.

The aforementioned skid-preventing protrusions may be integrally formed with the same material as the sole proper and the wrap-up portion; or the aforementioned skid-preventing protrusions may be formed as separate units from the sole proper and so forth, and may be integrally formed by insertion at the time the sole proper is formed.

Further, the surface of the aforementioned skid-preventing protrusions may be covered with a synthetic resin film.

The soles of the spiked track-and-field shoes according to the present invention are formed such that the wrap-up portion is formed via a coupling portion from the leading tip of the sole onto the toe region of the upper portion, and due to the multiple skid-preventing protrusions which are fixed onto the toe region of the sole proper, the coupling portion, and the wrap-up portion, the kick power of the athlete can be transferred to the running surface until the instant that the foot takes off from the ground, within a set of running motions.

Also, due to the multiple skid-preventing protrusions which are fixed onto the aforementioned toe region and on to the aforementioned wrap-up portion, respectively affixed perpendicular to the surface of the sole, the coupling portion and the surface of the wrap-up portion, the skid-preventing protrusions each pierce the running surface with certainty. From the time the toe region starts the kick to the time the foot takes off from the ground.

Further, due to the aforementioned skid-preventing protrusions being formed higher that a line that connects the tips of the spikes in the front row and the tips of the toe region of the sole, among the spike pins on the sole, the aforementioned skid-preventing protrusions pierce the running surface before the spike pins pull out of the running surface.

In addition, due to the formation thereof being lower than the height of the spike pins themselves, when the skid-preventing protrusions on the toe region pierce the running surface, the toe is not lifted up by the aforementioned skid-preventing protrusions in an unnatural manner, and resistance due to the aforementioned digging-up action is reduced when the aforementioned skid-preventing protrusions pull out.

The aforementioned skid-preventing protrusions may be integrally formed with the same material as the sole proper and the wrap-up portion at the time the sole is formed; or the aforementioned skid-preventing protrusions may be formed as separated units from a harder material than the sole proper and wrap-up portion, and by integrally forming it by insertion at the time the sole proper is formed, the aforementioned skid-preventing protrusions can be made to better withstand wear-and-tear.

Moreover, by enclosing the surface of the aforementioned skid-preventing protrusions in a synthetic resin film, the surface of the aforementioned skid-preventing protrusions can better withstand wear-and-tear, and also the resistance of the digging-up action is lessened at the time the aforementioned skid-preventing protrusions pull out of the running surface.

The following is a description of the embodiments of the spiked track-and-field shoes according to the present invention, with reference to the diagrams.

DESCRIPTION OF THE PREFERRED EMBODIMENT

Figure 1:
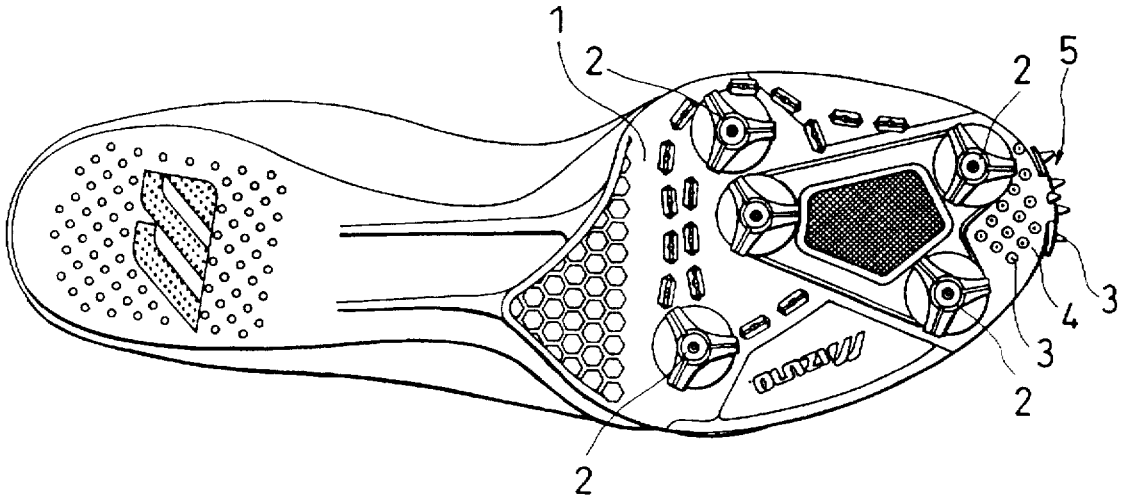
FIG. 1 is a bottom diagram of the sole for spiked track-and-field shoes according to the present invention.
Figure 2:
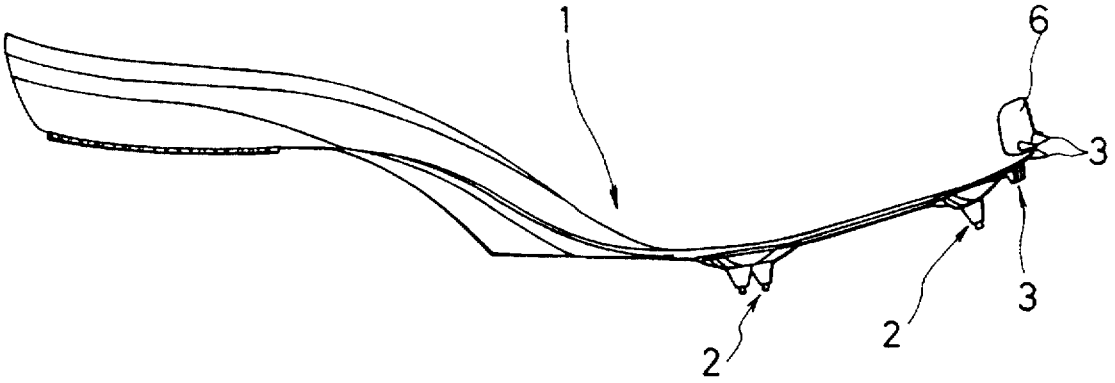
FIG. 2 a lateral view of the sole for spiked track-and-field shoes.

As shown in FIG. 1 and FIG. 2, the sole proper 1 of the soles of spiked field-and track shoes according to the present invention is formed using a synthetic resin such as polyamide (nylon) or polyurethane which provides excellent flexibility, and the spike pins 2 are affixed on the surface which touches the ground, either directly or via a spike attachment nut.

From the tip portion of toe region 4 of the aforementioned sole proper 1, a wrap-up portion 6 is formed via coupling portion 5, and multiple skid-preventing protrusions 3 are affixed onto coupling portion 5 and wrap-up portion 6 from the toe region 4.

Now, concerning the skid-preventing protrusions 3 which are affixed to toe region 4, it is preferred to arrange these in multiple rows, to compensate for individual differences or the angle of the kick.

The aforementioned skid-preventing protrusions 3 are all affixed perpendicular to the surface of the sole on the toe region 4, the coupling portion 5, and the wrap-up portion 6.

Figure 5:
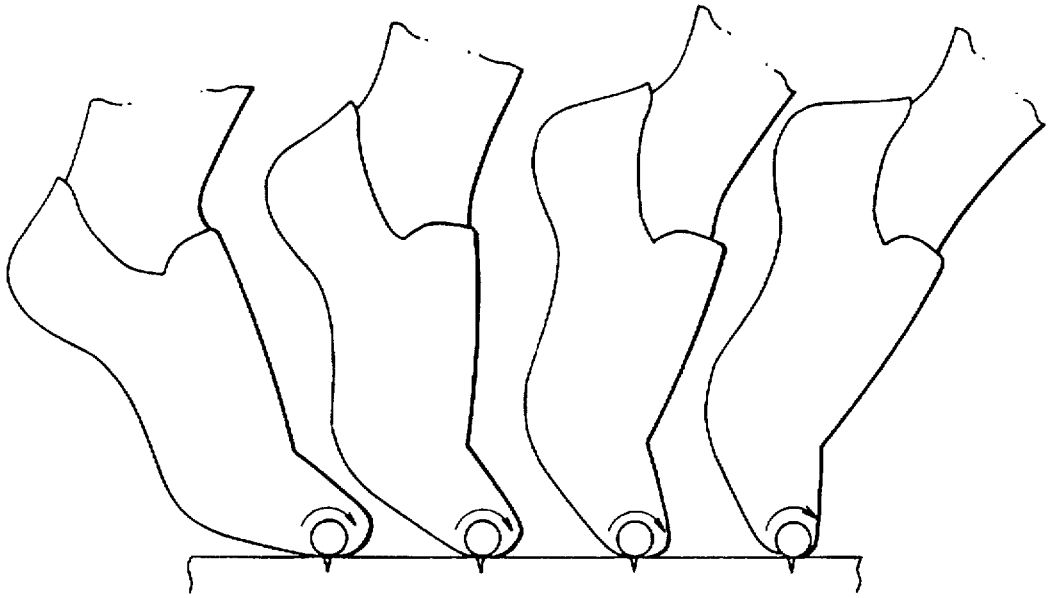
Fig. 5 is a conceptual diagram of the toe region in a state of contact with the ground before taking off from the ground during running motion.

For this reason, when the imaginary sphere supposed on the tip of the athlete's toe rolls along the running surface, as shown in FIG. 5, the skid-preventing protrusions 3 constantly pierce the running surface at every point of contact in a perpendicular manner.

Figure 6:
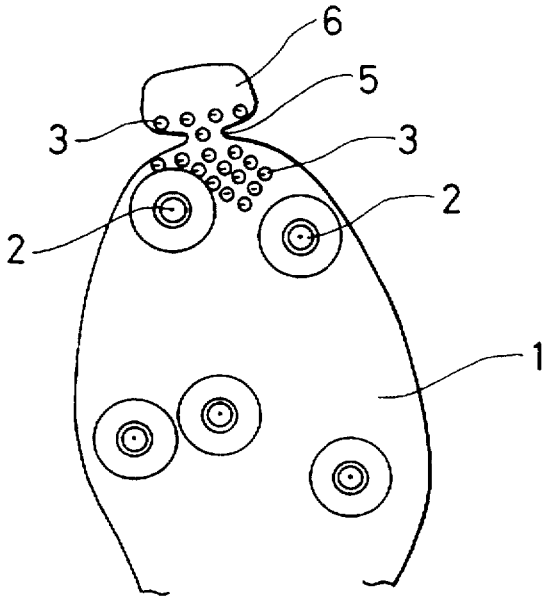
FIG. 6 is a schematic diagram of the sole for spiked track-and-field shoes, formed on a plane.
Figure 7:
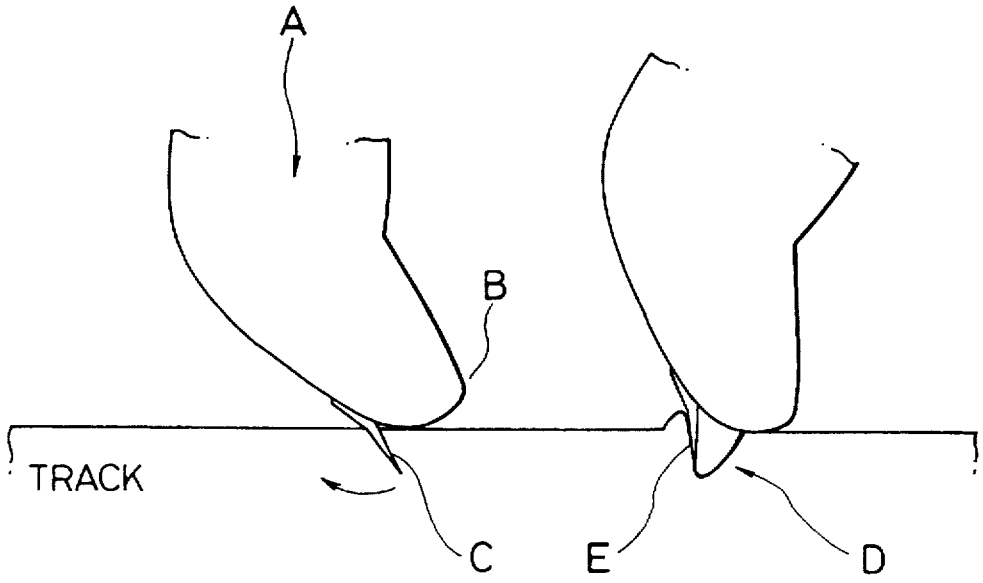
FIG. 7 is a conceptual diagram explaining the digging-up action.

Concerning spiked track-and-field shoes as disclosed in Japanese Utility Model Laid-Open No. 5-63308, as shown in FIG. 6, having the spike pins at the toe region being relatively long and protrude towards the front, a digging-up action occurs from the time the running surface is pierced until immediately before the foot takes off from the ground, and much effort is required.

In addition, there was the problem of which at the instant of take-off there was a great amount of friction on the back side of the spike pins, and the spike pins could not pull out as easily, and would in turn experience a loss.

Figure 3:
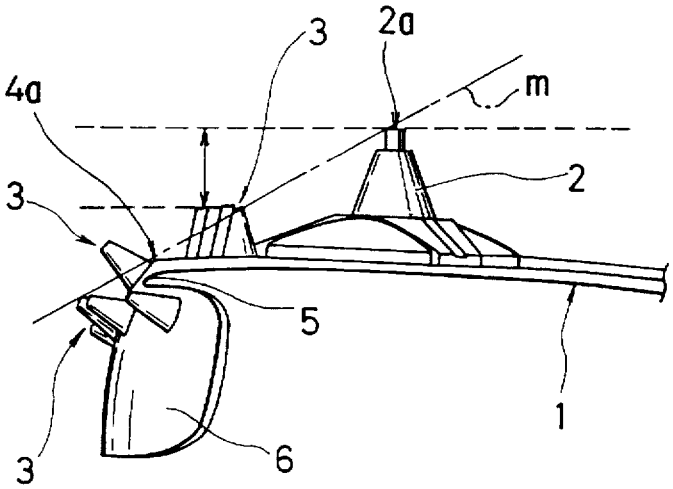
FIG. 3 is an enlarged diagram of the toe region to the area of the wrap-up portion of the sole for spiked track-and-field shoes.

On the other hand, as FIG. 3 shows, the height of skid-preventing protrusions 3 according to the present invention is formed higher than the line m which connects the tips 2*a* of spike 2 in the front row and the tips 4*a* of the toe region.

For this reason, within a set of running motions, the aforementioned skid-preventing protrusions 3 pierce the running surface before spike pins 2 in the front row pull out of the running surface, and after spike pins 2 pull out, skid-preventing protrusions 3 affixed onto the toe region 4, the coupling portion 5, and the wrap-up portion 6, respectively, in turn pierce the running surface, and therefore the kick power can be transferred to the running surface up until the instant of take-off from ground, without interruption.

In addition, because skid-preventing protrusions 3 are formed lower than the spike pins 2 themselves, once the skid-preventing protrusions 3 that have pierced the running surface pull out, the resistance of the spike pins 2 caused by the aforementioned digging-up process is lessened.

The specific height of the aforementioned skid-preventing protrusions 3 varies based on the height of spike pins 2 or on the distance between the front row of spike pins 2 and the tip of toe region 4, but the range of approximately 3 to 7 mm is most preferred.

Skid-preventing protrusions 3 relating to the present invention may be intergally formed using the same materials as sole proper 1, coupling portion 5, and wrap-up portion 6.

In this instance, the direct injection method for formation is generally used; however, difficulties may arise when designing the mold, such as the wrap-up portion 6 rising up from the bottom of the sore in a three-dimensional manner, as shown in FIG. 2.

In such a situation, as shown in FIG. 6, the coupling portion 5 and the wrap-up portion 6 may be formed upon approximately the same plane as the bottom surface of the sole, and during construction of the shoe, concerning the process of attaching the sole and the upper portion, the aforementioned wrap-up portion 6 may be pulled up from coupling portion 5, and affixed to the toe region of the shoe base.

The skid-preventing protrusions 3 according to the present invention may be formed as separate units from the sole proper 1, the coupling portion 5, and the wrap-up portion 6, and may be integrally formed by insertion at the time that sole proper 1 is formed.

The materials used to form the aforementioned skid-preventing. protrusions 3 may be the same material as that which is used to form the sole proper; however, synthetic resin materials which are harder and provide better wear-and-tear such as polycarbonate resin or polyacetal resin, or lightweight alloys such as titanium alloy may also be used.

In this instance, due to the freedom in the mold design, and the skid-preventing protrusions 3 affixed to the too region 4 through to the skid-preventing protrusions 3 affixed to the wrap-up portion 6 may be formed three-dimensionally.

The shape of skid-preventing protrusions 3 shown in the Figures are in the shape of a cone or a truncated cone; however, they need not be limited, but can be changed as necessary to shapes such as cylinders, polygonal cylinders, polygonal cones, or polygonal truncated cones, or variations thereof.

The surface of the aforementioned skid-preventing protrusions 3 may be coated with a synthetic resin film such as polyvinly chloride (PVC).

Concerning the method for coating, the film may be directly applied; however, conducting coating using the so-called Three-dimensional Curved surface Printing method "Curl-Pit Method (Registered Trademark: Dai-Nippon Insatsu)" is most preferred.

Due to the surface of the aforementioned skid-preventing protrusions 3 being hardened by means of covering with the aforementioned resin, the ability of the aforementioned skid-preventing protrusions 3 to withstand wear-and-tear is increased, and a the same time, the resistance is reduced when the aforementioned skid-prevention protrusions 3 pull out from the running surface.

Further, the aesthetics can be improved by not only coating skid-preventing protrusions 3 with the aforementioned resin, but also covering all of the surface of sole proper 1 which comes in contact with the ground, or parts of the surface thereof.

Figure 4:
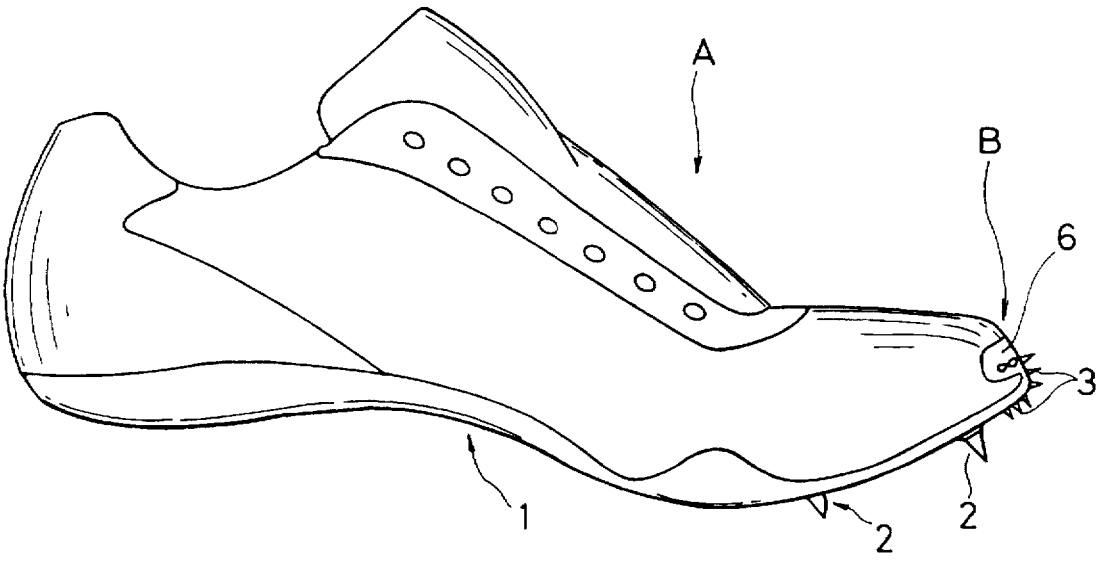
FIG. 4 is a lateral view of spiked track-and-field shoes using the sole for spiked track-and-field shoes.

The soles for spiked track-and-field shoes which relate to the present invention are used, as shown in FIG. 4, by attaching the aforementioned coupling portion 5 and the wrap-up portion 6 to the spiked track-and-field shoes by means such as adhesion or sewing.

[Effects of the invention]

Due to the soles for spiked track-and-field shoes according to the present invention constructed as described above, during a set of running motions, the kick power of the athlete can be translated to the running surface with certainty, from the time the toe portion begins the kick to the instant the foot taken off from the ground, without interruption.

Further, the skid-preventing protrusions according to the present invention do not lift the toe region up in an unnatural manner, and they succeed in greatly reducing the amount of resistance from digging-up actions.

In addition, due to several skid-preventing protrusions being affixed in rows, particularly to the toe region, the aforementioned skid-preventing protrusions can solve conventional problems such as skid-preventing protrusion not being able to effectively grip the running surface depending on the angle of the kick or personal differences.

Concerning the soles for spiked track-and-field shoes according to the present invention, the aforementioned skid-preventing protrusions may be intergrally formed with the sole proper at the time the sole is formed, or may be formed separately. For this reason, there is greater freedom of design for the sole.

Therefore, the aforementioned sole need not be limited to sprint events, but may be adapted for use in spiked shoes used for medium distance and long distance or even for other field events, Further, by covering the surface of the aforementioned skid-preventing protrusions with a synthetic resin film the ability of the surface of the aforementioned skid-preventing protrusions to withstand wear-and-tear is improved, and further, the resistance when the spike pins pull out of the running surface due to the digging-up action is reduced, and this can contribute to the improvement of records. In addition, where design is concerned, an aesthetically pleasing sole not conventionally available can be provided.

I claim:

1. A sole for a spiked track-and-field shoe comprising:

a plurality of spike pins, a wrap-up portion extending, via a coupling portion, from a leading tip of a toe region of a sole proper, and multiple skid-preventing protrusions fixed onto the toe region of the sole proper, the coupling portion, and the wrap-up portion perpendicular to the toe region of an underneath part of the sole, a surface of the coupling portion, and a surface of the wrap-up portion, respectively, said skid-preventing protrusions being formed to extend past a line which connects a first row of the tips of the spike pins and the leading tip of the toe portion but not past the spike pins, the wrap-up portion being affixed to a toe region of an upper portion of the spiked track-and-field shoe.

2. A sole for spiked track-and-field shoes according to claim 1, wherein the skid-preventing protrusions are formed integrally with and from the same material as the sole proper and the wrap-up portion.

3. A sole for spiked track-and-field shoes according to claim 1, wherein the skid-preventing protrusions are formed as separate units from the sole proper and the wrap-up portion, and integrally formed by insertion into the sole proper.

4. A sole for spiked track-and-field shoes according to claim 1, wherein the surface of each of the skid-preventing protrusions is coated with a synthetic resin film.

* * * * *